US006068229A

United States Patent [19]

Wang et al.

[11] Patent Number: 6,068,229

[45] Date of Patent: May 30, 2000

[54] ATTACHABLE CLAMPING UNIT FOR DECORATIVE LIGHT BULB SOCKET

[76] Inventors: Jessica Wang; Dennis Wang, both of 4F-3, No. 77, Sec. 2, TUN HWA South Road, Taipei, Taiwan

[21] Appl. No.: 09/025,491

[22] Filed: Feb. 18, 1998

[51] Int. Cl.[7] ..... F21V 21/00

[52] U.S. Cl. ..... 248/314; 362/249; 362/396

[58] Field of Search ..... 248/68.1, 74.2, 248/316.7, 690, 692, 682.314; 362/249, 391, 396, 806

[56] References Cited

U.S. PATENT DOCUMENTS

| | | | |
|---|---|---|---|
| 1,861,151 | 5/1932 | Buschman | 362/396 X |
| 1,895,656 | 1/1933 | Gadke | 362/396 X |
| 2,331,877 | 10/1943 | Welfield et al. | 362/396 |
| 2,703,359 | 3/1955 | Miller | 362/396 |
| 4,306,697 | 12/1981 | Mathews | 248/74.2 X |
| 4,802,072 | 1/1989 | Kau | 362/806 X |
| 4,890,206 | 12/1989 | Lee | 362/249 X |
| 5,632,552 | 5/1997 | Wang et al. | 362/396 |
| 5,697,698 | 12/1997 | Huang | 362/249 X |
| 5,775,802 | 7/1998 | Kuo | 362/249 X |
| 5,779,352 | 7/1998 | Lin | 362/249 |
| 5,839,820 | 11/1998 | Huang | 362/391 X |
| 5,893,634 | 4/1999 | Wang | 362/249 |
| 6,004,006 | 12/1999 | Wang | 362/249 |

*Primary Examiner*—Anita M. King
*Attorney, Agent, or Firm*—Pro-Techtor International Services

[57] ABSTRACT

An attachable clamping unit adapted to be associated with a decorative light bulb socket is disclosed. The attachable clamping unit is provided with a ring member and a wire clamping hook structure. The wire clamping hook structure is formed on the outer side wall of the ring member for hooking electrical connecting wires adjacent thereto so as to form a decorative light web string. The clamping unit further comprises a light bulb socket joining structure formed on the outer side wall of the ring member for joining the light bulb socket adjacent thereto. The light bulb socket joining structure includes a C-shaped member and a cylindrical member.

2 Claims, 6 Drawing Sheets

ATTACHABLE CLAMPING UNIT FOR DECORATIVE LIGHT BULB SOCKET

FIELD OF THE INVENTION

The present invention relates generally to a clamping structure for a decorative light bulb socket, and more particularly to a clamping unit with a wire clamping hook structure and a light bulb socket joining structure. By means of the clamping unit, the decorative light bulb socket is capable of releasably holding the light bulb sockets and/or the wires adjacent thereto in a desired pattern to provide a more appealing decorative light.

BACKGROUND OF THE INVENTION

Decorative light strings have been widely used in all kinds of celebration and festival. The decorative light strings comprise electrical connecting wires of a substantial length to which a plurality of the lamp bulbs are connected by means of light bulb socket fixed on the wires, preferably in spaced manner.

As shown in FIG. 1, there is shown a conventional decorative light string which comprises electrical connecting wires 3 on which light bulb sockets 1 are fixed to each receive and hold therein a light bulb 2 that is in electrical connection with the wires 3. A plug and a socket (not shown) may be provided to the electrical connecting wires for connection with an external power source and to provide an electrical connection to another light string.

The decorative light string may be arranged in a form of decorative light web string. The light string may be attached to any desired article or object, such as a tree, a window or a curtain. The arrangement of the light string on an article may be in any arbitrary pattern by fixing the wires and the light bulb sockets to the article and to themselves.

The present invention is directed to a decorative light bulb socket with a separable clipping structure or clamping structure to provide ready fixing of the light bulb sockets and the wires together so that generally consumers may arrange the light string in any desired manner and pattern and may re-arrange the light string readily.

SUMMARY OF THE INVENTION

Therefore, the principal object of the present invention is to provide an attachable clamping structure for a light bulb socket of the decorative light string. The clamping unit is provided with a wire clamping hook structure for clamping electrical connecting wires adjacent thereto together in a desired pattern to provide a decorative light web string.

In a preferred embodiment of the present invention, the attachable clamping unit comprises a ring member for clamping on the decorative light socket and a wire clamping hook structure formed on the outer side wall of the ring member for hooking the connecting wires adjacent thereto. The wire clamping hook structure comprises at least one S-shaped hook formed on the outer side wall of the ring member, one end of the hook being an open end and the other end of the hook being mounted on the outer side wall of the ring member.

Another object of the present invention is to provide a clamping unit which further comprised a light bulb socket joining structure for holding a light bulb socket adjacent thereto to form a more versatile decorative light web string. The light bulb socket joining structure is formed on the outer side wall of the ring member for joining the light bulb socket together adjacent thereto. The light bulb socket joining structure comprises a C-shaped member and a cylindrical member, arranged on the outer side wall of the ring member in opposite arrangement. Preferably, the C-shaped member of the light bulb socket joining structure is further provided with a base plate formed on the bottom portion thereof.

BRIEF DESCRIPTION OF THE DRAWINGS

The present invention will be described in further detail with reference to the accompanying drawings, wherein.

DETAILED DESCRIPTION OF THE PREFERRED EMBODIMENT

Figure 1:
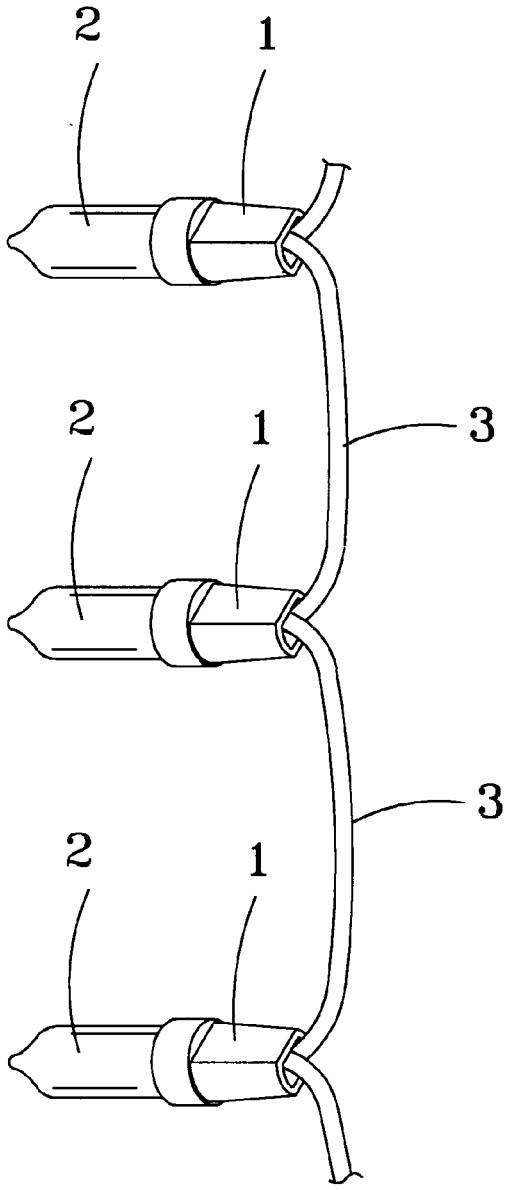
FIG. 1(PRIOR ART)
FIG. 1 shows that a conventional decorative light string is composed of a number of light bulbs, light bulb sockets, and electrical connecting wires.
Figure 2:
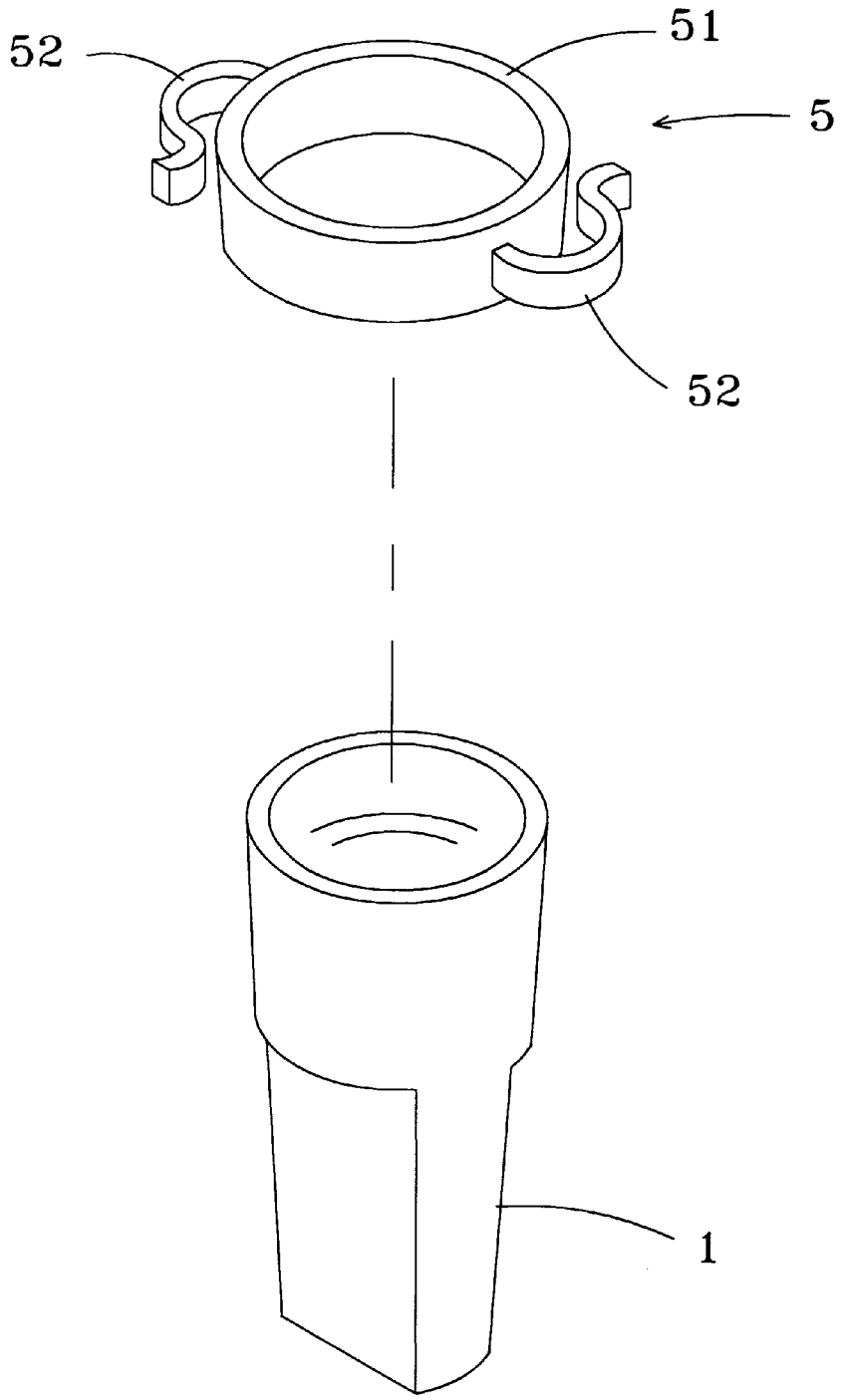
FIG. 2 is a perspective view showing a clamping unit is separated from the light bulb socket in accordance with a first embodiment of the present invention.

With reference to the drawings and in particular to FIG. 2, there is shown a clamping unit generally designated with reference numeral 5 in accordance with the first embodiment of the present invention. The clamping unit 5 is provided with a ring member 51 and at least one wire clamping hook structure 52. For example, there are two wire clamping hook 52 formed on the outer side wall of the ring member 51 in opposite arrangement.

Figure 3:
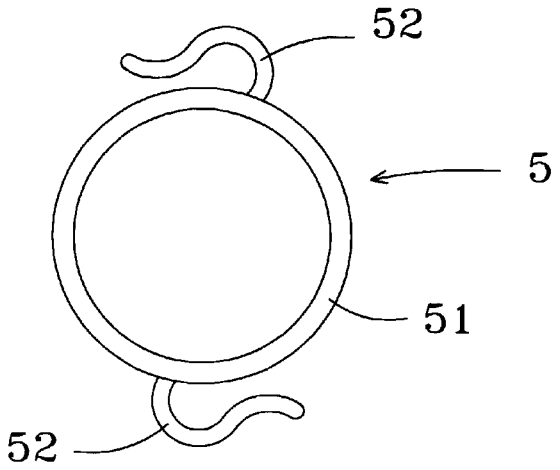
FIG. 3 is a top plan view of the clamping unit shown in FIG. 2.

In a preferred embodiment of the present invention, the wire clamping hook structure 52 is in a form of S-shaped hook. FIG. 3 shows a top plan view of the clamping unit of the present invention. The S-shaped hook 52 is formed on the outer side wall of the ring member, one end of the hook being an open end and the other end of the hook being mounted on the outer side wall of the ring member.

Figure 4:
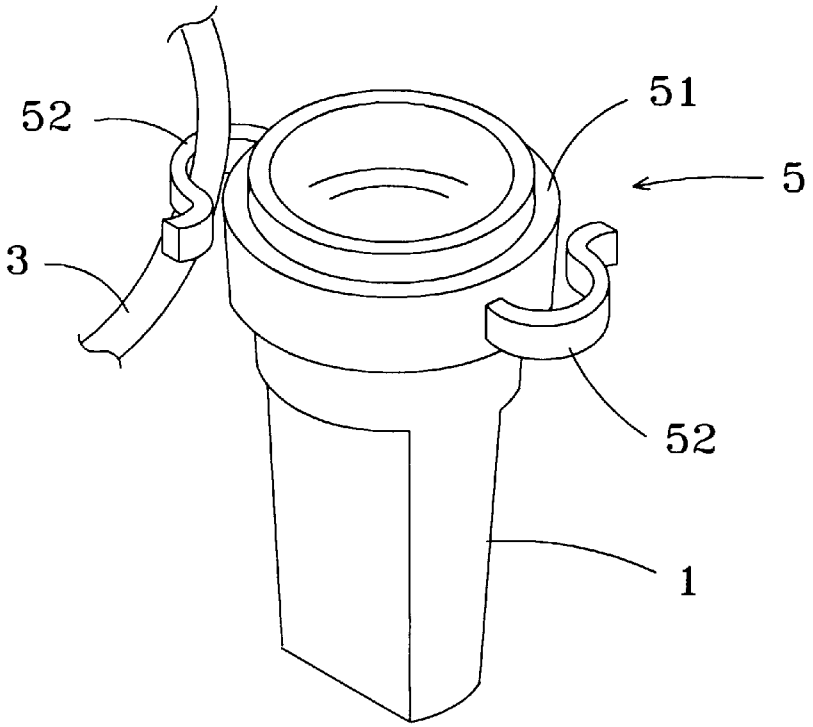
FIG. 4 is a perspective view showing the clamping unit is clamped on the light bulb socket of FIG. 2.

The wire clamping hook structure 52 may be clamped on the light bulb socket 1, as shown in FIG. 4. In addition, by means of the wire clamping hook structure, the light bulb socket 1 may hook electrical connecting wires 3 adjacent to it in a desired pattern to provide a decorative light web string.

Figure 5:
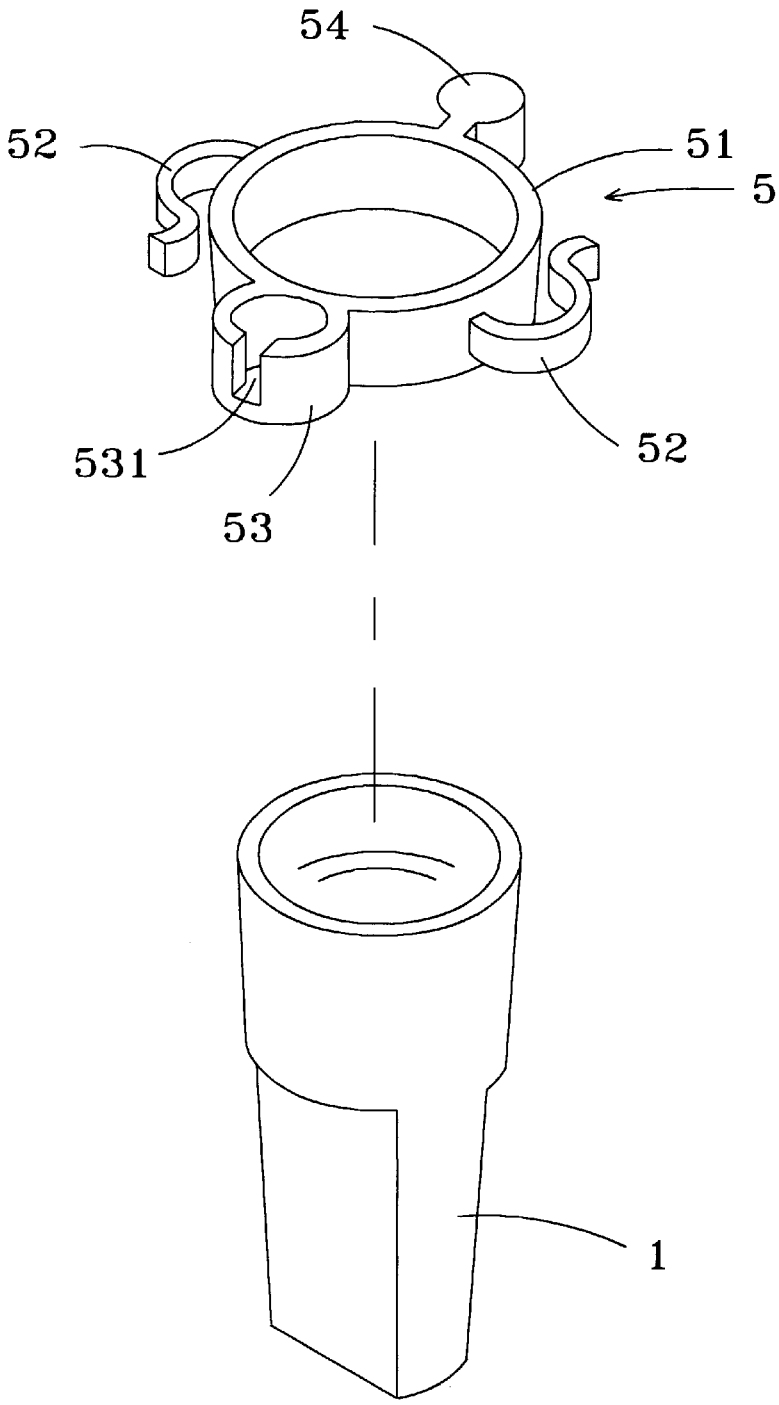
FIG. 5 is a perspective view showing a clamping unit is separated from the light bulb socket in accordance with a second embodiment of the present invention.
Figure 6:
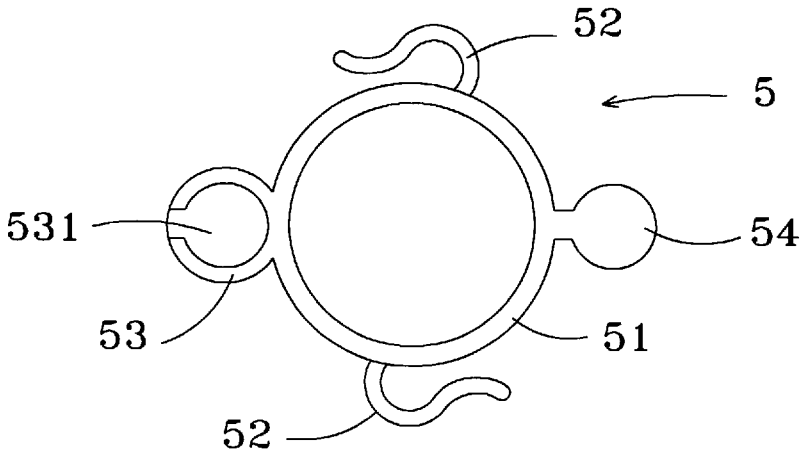
FIG. 6 is a top plan view of the clamping unit shown in FIG. 5.

With reference to FIG. 5, there is shown a clamping unit 5 in accordance with the second embodiment of the present invention. The same reference numbers used in the previous embodiment will be used in this embodiment to refer to the same parts. Similar to the first embodiment as shown in FIG. 2 described above, the clamping unit 5 of the second embodiment of the present invention is also provided with a ring member 51 and at least one wire clamping hook structure 52, with reference to FIG. 6.

Similarly, in the second embodiment of the present invention, the wire clamping hook structure 52 is in a form of S-shaped hook. The S-shaped hook 52 is formed on the outer side wall of the ring member 51, one end of the hook being an open end and the other end of the hook being mounted on the outer side wall of the ring member.

Figure 7:
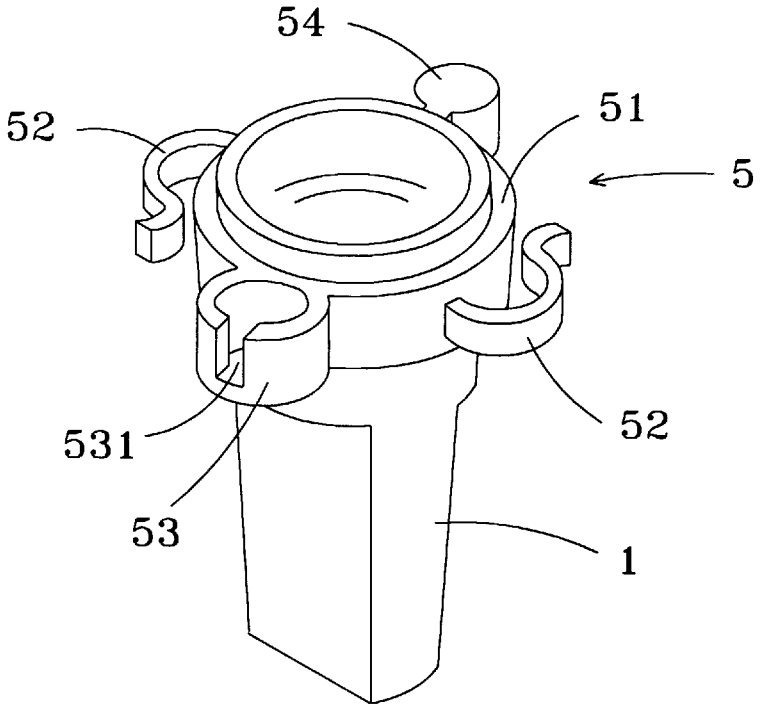
FIG. 7 is a perspective view showing the clamping unit is clamped on the light bulb socket of FIG. 5.

In addition, the clamping unit 5 of this embodiment further comprises a light bulb socket joining structure formed on the outer side wall of the ring member 51 of the clamping unit 5 for joining the light bulb socket together adjacent thereto, as shown in FIG. 7. The light bulb socket joining structure comprises a C-shaped member 53 and a cylindrical member 54, arranged on the outer side wall of the ring member 51 in opposite arrangement.

Figure 8:
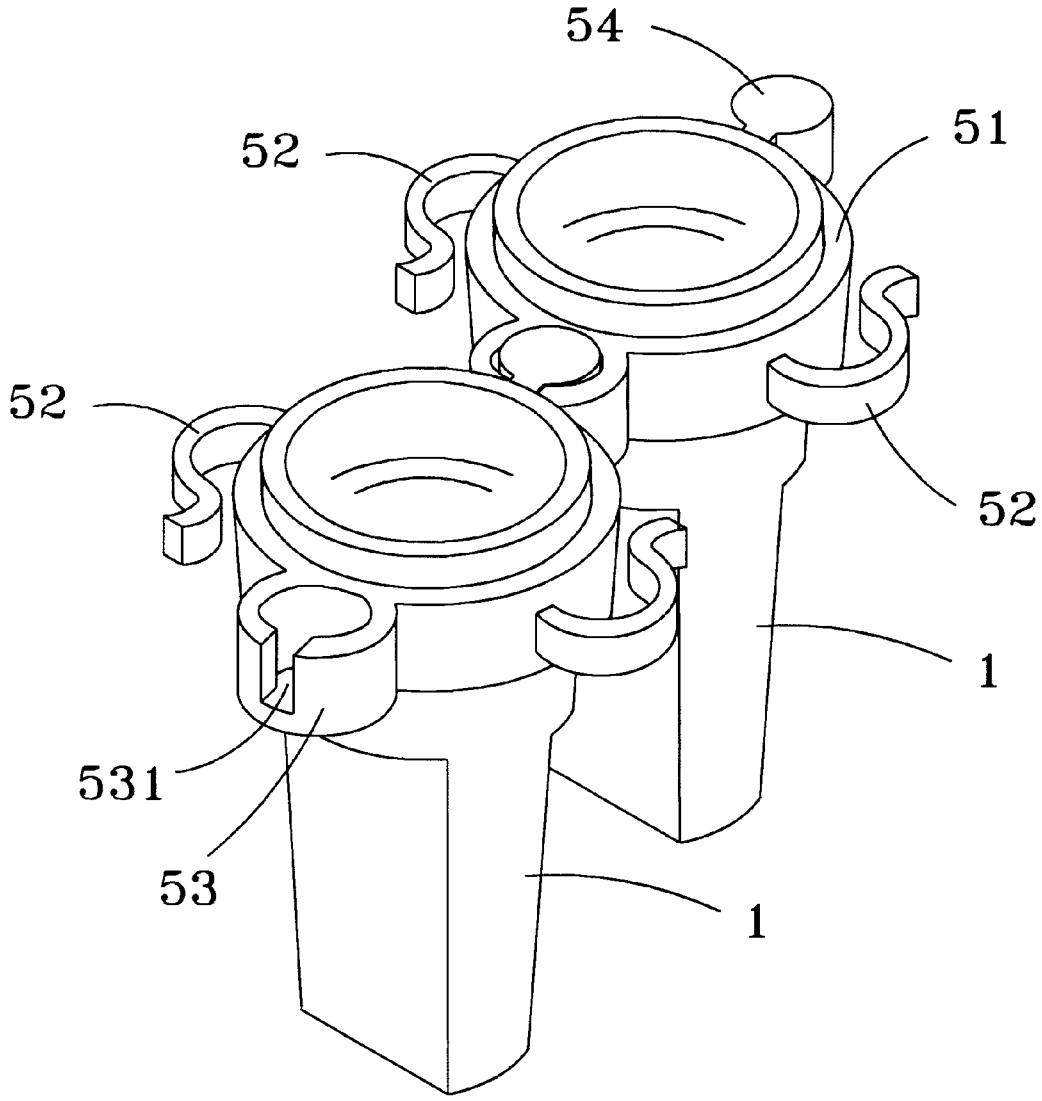
FIG. 8 is a perspective view showing two light bulb sockets are joint together by means of clamping units thereof.

During joining two adjacent light bulb sockets, with reference to FIG. 8, the cylindrical member 54 of one light bulb socket is mounted in the C-shaped member 53 of the other light bulb socket as shown in FIG. 7.

Furthermore, the C-shaped member 53 of the light bulb socket joining structure further comprises a base plate 531 formed on the bottom portion of the C-shaped member 53. The base plate 531 serves as a stop plate for the cylindrical member of the other light bulb socket during joining operation.

By means of the wire clamping hook structure, the light bulb socket 1 may hook electrical connecting wires 3 adjacent to it in a desired pattern to provide a decorative light web string. In addition, by means of the light bulb socket joining structure of the second embodiment of the present invention, the light bulb socket can join a light bulb socket adjacent thereto in a desired pattern to provide a more versatile decorative light web string.

It is apparent that although the present invention is illustrated with the description of the preferred embodiments thereof, it is contemplated that there may be changes and modifications in the described embodiments that can be carried out without departing from the scope of the invention which is intended to be limited only by the appended claims.

What is claimed is:

1. A removable clamping unit adapted for a decorative light bulb socket comprising:

a ring member with a central opening, said central opening is adapted to receive and removably secure the light bulb socket, said ring member includes on an exterior thereof a wire clamping hook structure, said wire clamping hook structure is adapted to secure electrical wires and comprises a joining structure formed on said exterior of said ring member, said joining structure includes means to removably secure a joining structure on another wire clamping hook structure, and said joining structure comprises a C-shaped member and a cylindrical member, said C-shaped member and said cylindrical member being secured on opposing sides of said ring member.

2. The removable clamping unit as claimed in claim 1 wherein:

said C-shaped member further comprises a base plate formed on a bottom portion thereof.

* * * * *